United States Patent [19]

Levine

[11] 4,291,551

[45] Sep. 29, 1981

[54] COMBINATION EARRING AND FINGER RING

[76] Inventor: Harriet B. Levine, 7530 Stonecrest, Dallas, Tex. 75240

[21] Appl. No.: 194,628

[22] Filed: Oct. 6, 1980

[51] Int. Cl.[3] ..... A44C 7/00; A44C 9/00

[52] U.S. Cl. ..... 63/12; 63/15

[58] Field of Search ..... 63/1 R, 2, 12, 13, 15

[56] References Cited

U.S. PATENT DOCUMENTS 241,381 5/1881 Krementz ..... 63/12
498,648 5/1893 Gumbart ..... 63/1 R

FOREIGN PATENT DOCUMENTS 8855 2/1880 Fed. Rep. of Germany ..... 63/12
1069565 5/1967 United Kingdom ..... 63/12
1206595 9/1970 United Kingdom ..... 63/12

*Primary Examiner*—F. Barry Shay
*Attorney, Agent, or Firm*—Sigalos & Levine

[57] ABSTRACT

A combination finger ring and earring comprising an arcuate section of a ring body having first and second ends, an earring stem for a pierced ear attached to the first ring end, an earring fastener removably attached to and mating with the stem when the stem is inserted through a pierced ear for use as an earring, and an extension pivotally attached to the second end for rotation toward the ring body adjacent to the second end when the earring is used and for rotation toward the ring body adjacent to the first end to form a circle when the finger ring is used.

8 Claims, 4 Drawing Figures

COMBINATION EARRING AND FINGER RING

BACKGROUND OF THE INVENTION

The present invention relates to a dual function jewelry item in the form of a combination earring and finger ring and in particular to a combination that can be used as an earring and quickly and easily converted to a finger ring if desired.

A multitude of different types of rings for wearing on the fingers are well-known in the art. These rings not only have different ornamental designs but also are adjustable in size and have other unique features.

Earrings are also made in a wide variety of shapes, sizes, ornamental designs, and the like. Thus, the average individual owns or wears one or more rings and the average female purchases many different types of earrings.

SUMMARY OF THE INVENTION

The present invention relates to a multi function item of ornamental jewelry that unexpectedly can be used both as an earring and as a finger ring. Thus, it is a relatively inexpensive way to get dual use out of one piece of ornamental jewelry that can have multiple functions.

Thus, the invention relates to a combination finger ring and earring comprising an arcuate section of a ring body having first and second ends, an earring stem for a pierced ear attached to said first ring end, an earring fastener for mating with said stem when said stem is inserted through a pierced ear as an earring, and an extension pivotally attached to said second end for rotation toward said ring body adjacent to said second end when said earring is used and for rotation toward said ring body adjacent to said first end to form a circle when said finger ring is used.

DETAILED DESCRIPTION OF THE DRAWINGS

Figure 1:
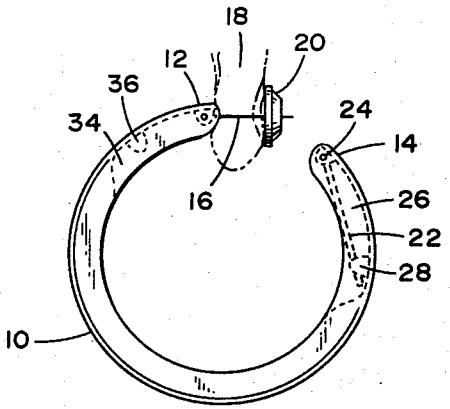
FIG. 1 is an illustration of the novel combination when it is being used as an earring.
Figure 3:
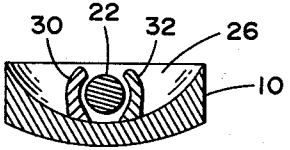
FIG. 3 is a cross-sectional view of the novel device taken along lines 3-3 in FIG. 2.

FIG. 1 is an illustration of the unique and novel device according to this invention when it is being used as an earring. The novel ornamental piece of jewelry comprises an arcuate section 10 of a ring body made, for example, of precious metal such as gold or silver having a first end 12 and a second end 14. Pivotally attached to said first end 12 is an earring stem 16 which is shown extending through the phantom outline of a human ear lobe 18. An earring fastener 20, well-known in the art, mates with said stem 16 to keep the earring attached to the ear lobe 18 of the wearer. An extension 22 is pivotally attached to said second end 14 at 24 for rotation toward said ring body 10 adjacent to said second end 14 as shown in FIG. 1 when the device is being used as an earring. Extension 22 rests within a recess 26 in ring body 10 for receiving extension 22 so that it is inconspicuous when the novel device is being used as an earring. A retaining device 28 is located in recess 26 in order to maintain extension 22 therein during the time the device is being used as an earring. The retaining means 28 is shown in FIG. 3 and is shown as first and second mounts 30 and 32 which are so constructed as to grasp extension 22 and hold it securely within recess 26.

A second recess 34 is located in the first end 12 of ring body 10 for receiving stem 16 when the novel device is to be used as a finger ring. Of course, fastener 20 has to be removed before the stem 16 can be pivoted into recess 34. Recess 34 also has a fastening means 36 such as that illustrated in FIG. 3 in order to retain stem 16 therein when the novel device is not being used as an earring.

Figure 2:
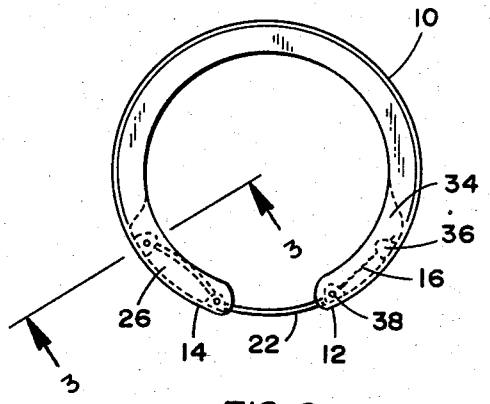
FIG. 2 is an illustration of the novel combination when it is to be used as a finger ring.

FIG. 2 is an illustration of the unique and novel ornamental jewelry according to this invention when it is to be used as a finger ring. In that case, the extension 22 has been pivoted out of recess 26 where it had previously rested (shown in dashed lines) and rotated toward the ring body 10 adjacent to first end 12 to form a circle. The extension 22 may be generally of an arcuate shape as shown which closes the gap between first and second ends 12 and 14 and substantially forms a circle. In this position, stem 16 has been pivoted inwardly about pivot point 38 to rest in recess 34. It is retained therein as explained earlier by the retaining means 36.

Of course, recesses 26 and 34 could both be located on the outside of the ring body 10 rather than on the inside or, if desired, one of the recesses could be on the outside and the other on the inside. This would allow different configurations of the unique and novel combination ring/earring to be manufactured.

Figure 4:
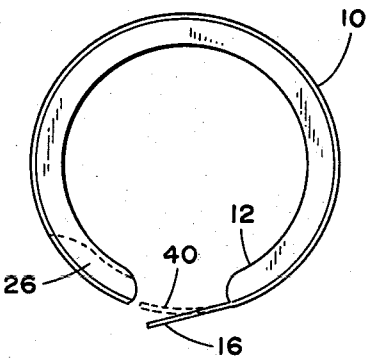
FIG. 4 is an illustration of a second embodiment of the novel device in which the earring stem is fixedly attached to one end of the ring body.

FIG. 4 is an alternate embodiment of the unique and novel combination in which stem 16 is rigidly attached to ring end 12 so that it can be pivoted toward the ring end 12 when the device is to be used as a finger ring. Instead, the stem 16 is made of a soft metal such as gold which will enable it to be bent towards position 40 (shown in dashed lines) where it would simply be out of the way. In such case, the extension 22, not shown in FIG. 4, could be pivoted as described earlier out of its recess 26, shown on the outside of the ring body 10 in FIG. 4, toward ring end 12. If desired, of course, the extension 22 could be pivoted from the inside as shown in FIG. 1 and FIG. 2.

Thus, a unique and novel multi function item of ornamental jewelry has been disclosed which provides a combination earring and finger ring. This novel design allows a person to have significantly greater use of jewelry at a substantially reduced cost, noting the very high (and continually increasing) cost of precious metals today, especially gold. By placing an extension in a recess on one end of the arcuate ring body section, and a second recess on the other end of the ring body, an earring stem may be located in the second recess and may be pivoted outwardly when the device is used as an earring and inwardly when the device is used as a finger ring while the extension is maintained in the other recess when the device is used as an earring and is pivoted outwardly to substantially form a circle with the remainder of the ring body when the device is to be used as a finger ring.

While the invention has been described in connection with a preferred embodiment, it is not intended to limit the scope of the invention to the particular form set forth, but, on the contrary, it is intended to cover such alternatives, modifications and equivalents as may be included within the spirit and scope of the invention as defined by the appended claims.

What is claimed is:

1. A combination finger ring and earring comprising:

(a) an arcuate section of a ring body having first and second ends.

(b) an earring stem for a pierced ear attached to said first ring end, (c) an earring fastener removably attached to and mating with said stem when said stem is inserted through a pierced ear for use as an earring, and (d) an extension pivotally attached to said second end for rotation toward said ring body adjacent to said second end when said earring is used and for rotation toward said ring body adjacent to said first end to form a circle when said finger ring is used.

2. A combination finger ring and earring as claim 1 wherein said earring stem is pivotally attached to said first ring end whereby said stem may pivot out of the way when said finger ring is formed.

3. A combination finger ring and earring as in claim 2 further including:

(a) a first recess in said first end of said ring body for receiving said stem when said finger ring is formed, and (b) a second recess in said second end of said ring body for receiving said extension when said earring is formed.

4. A combination finger ring and earring as in claim 3 wherein said first and second recesses are formed on the inside of said ring body.

5. a combination finger ring and earring as in claim 3 wherein said first and second recesses are formed on the outside of said ring body.

6. A combination finger ring and earring as in claim 3, wherein one of said first and second recesses is formed on the inside of said ring body and the other is formed on the outside of said ring body.

7. A combination finger ring and earring as in claim 3 further including means in each of said first and second recesses for retaining the stem and extension received in the corresponding recess.

8. A combination finger ring and earring as in claim 1 wherein said stem is integrally formed with said first ring body end and is made of soft metal to permit said stem to be bent in a direction to substantially form a circle when said finger ring is formed.

* * * * *